United States Patent [19]

Bays

[11] Patent Number: 4,802,787

[45] Date of Patent: Feb. 7, 1989

[54] ELECTRICAL CONTROL SYSTEM

[75] Inventor: Marvin G. Bays, Ponca City, Okla.

[73] Assignee: Mertz, Inc., Ponca City, Okla.

[21] Appl. No.: 111,767

[22] Filed: Oct. 23, 1987

Related U.S. Application Data

[63] Continuation-in-part of Ser. No. 940,981, Dec. 12, 1986.

[51] Int. Cl.[4] ..... E01C 23/12

[52] U.S. Cl. ..... 404/90; 404/133; 404/84; 173/11; 173/13; 172/5; 172/12; 172/40

[58] Field of Search ..... 404/84, 90, 91, 133; 299/26, 36–40, 69, 70; 173/2, 11, 13, 15; 172/2, 5, 6, 7, 12, 40; 37/232, 234, DIG. 1, DIG. 20

[56] References Cited

U.S. PATENT DOCUMENTS

| | | | |
|---|---|---|---|
| 1,250,521 | 12/1917 | Schumacher | 299/37 X |
| 1,841,802 | 1/1932 | Gettelman | 299/37 |
| 2,529,892 | 11/1950 | Adams | 299/37 X |
| 3,133,730 | 5/1964 | Cornett | 404/90 X |
| 3,329,930 | 7/1967 | Cole et al. | 340/17 |
| 4,250,760 | 2/1981 | Gurries | 299/37 X |
| 4,251,111 | 2/1981 | Gurries | 299/37 |
| 4,258,956 | 3/1981 | Gurries | 299/37 X |
| 4,340,255 | 7/1982 | Gurries | 299/37 |
| 4,402,629 | 9/1983 | Gurries | 404/90 |
| 4,457,645 | 7/1984 | Klochko | 404/90 |
| 4,511,282 | 4/1985 | Gurries | 404/90 |
| 4,515,408 | 5/1985 | Gurries | 404/90 X |

FOREIGN PATENT DOCUMENTS

| | | | |
|---|---|---|---|
| 846720 | 7/1981 | U.S.S.R. | 404/133 |

*Primary Examiner*—Stephen J. Novosad
*Assistant Examiner*—John F. Letchford
*Attorney, Agent, or Firm*—William J. Miller

[57] ABSTRACT

A control apparatus for a pavement breaker which includes a carriage, a lifting means for raising and lowering an impact arm which impact arm includes a tool for impacting a surface, mounted on one end and an oscillating member mounted on the other end. The control apparatus basically includes electrical apparatus for measuring the total weight being applied through the lifting means to the tool when it is in contact with the surface to be impacted and apparatus for limiting the amount of horizontal force that can be applied to the impact arm during the process of impacting the surface of the earth. A processor receives an electrical signal from the electrical apparatus which is applied to the lift control apparatus in a manner to stabilize the lifting force. A signal output is generated by the horizontal force limiting apparatus when a predetermined amount of horizontal force is received by the electrical device. The generated output signal is communicated to the lift control apparatus for removing the vertical force or weight from the tool to an extent necessary to remove the excessive horizontal force being applied to the impacting apparatus.

10 Claims, 3 Drawing Sheets

ELECTRICAL CONTROL SYSTEM

RELATED APPLICATIONS

This application is a continuation in part of U.S. Pat. No. 940,941, filed Dec. 12, 1986, by Marvin Gene Bays, entitled "Surface Crushing Apparatus". This Application is assigned to the same Assignee as the above referenced co-pending Application.

BRIEF DESCRIPTION OF THE CONTINUATION IN PART APPLICATION

In the continuation-in-part application an apparatus is described which is capable of breaking a hard surface such as a concrete road or bridge deck and essentially consists of a support for a torsional spring which is horizontally fixed to the support with a spaced rotational journal so that the torsional spring is supported substantially horizontally. An oscillating member of desired mass characteristics is attached to the torsional spring with a force generating apparatus such as a hydraulic vibrator on one end of the oscillating member and a road crushing tool on the opposite end of the oscillating member. The oscillating member is attached rigidly to the torsional spring. Lifting apparatus is also provided for positioning the impact or road crushing tool against the surface to be crushed in a manner to maintain the tool in that position during the crushing operation.

BRIEF DESCRIPTION OF THE INVENTION

This invention relates particularly to an apparatus for maintaining an impact tool in position against the surface of the earth with a predetermined amount of vertical force during the crushing operation and, in particular, also includes means for preventing excessive horizontal force from being applied to the crushing apparatus if the crushing apparatus should get lodged against debris during the crushing operation while the vehicle is in motion.

The invention essentially comprises a linearlly variable differential transformer hereinafter referred to as a LVDT sensing apparatus being attached across one of a plurality of shock mounts which are in turn attached between a portion of the lifting apparatus and the mass supporting the torsional spring. The amount of compression of the isolation means is a measure of the weight being applied to the impact tool. When the weight reaches a predetermined amount, then the sensing apparatus, through an electronic processing apparatus, applies a signal to the lifting apparatus in a manner to stabilize the force being applied to the impact tool.

When the tool is in use and the impact tool should get lodged, for example, against a piece of unbroken concrete while the vehicle is moving, then excessive horizontal force will be applied against the impact tool and against the isolation apparatus used to isolate the impact tool and its associated mass and torsional spring from the vehicle carrying the above reference apparatus.

To sense an excessive horizontal force, a microswitch is mounted on the frame. A switch arm communicates with the mass so that if the mass shifts horizontally, the arm will impact or press against the microswitch arm in a manner to cause a signal to be generated to a second electronic circuit which will generate an output signal in response to the excessive horizontal force. The output signal is then communicated to the lifting apparatus which will lift the tool until it is free from the excessive horizontal force. Once the condition has been removed, the signal will be removed from the micro-switch and the pre-determined vertical force will again be applied to the impact tool so that the impact tool can continue to break pavement.

DETAILED DESCRIPTION OF THE INVENTION

Figure 1:
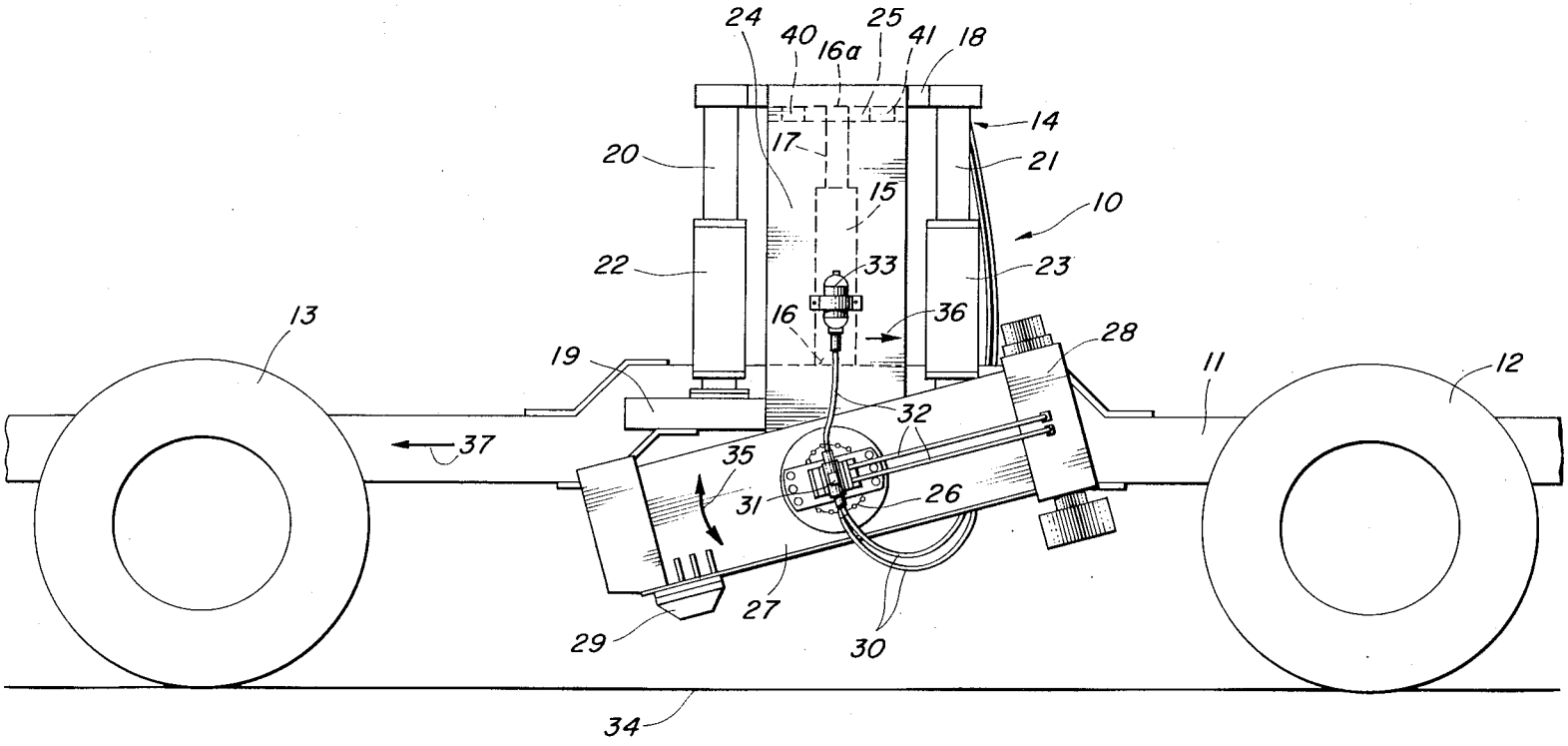
FIG. 1 is a side view of the vehicle which carries the road breaking equipment.

Referring to all of the FIGURES, but in particular to FIG. 1, a vehicle carrying impacting equipment is generally referred to by arrow 10. Vehicle 10 has a base 11 and wheels 12 and 13. Wheels 12 comprise a pair of wheels journaled by means of an axle (not illustrated) which is attached through suitable bearings to base 11. Wheels 13, likewise, comprise a pair of wheels journaled through an axle (not illustrated) to base 11. Wheels 12 or 13 can be hydraulically driven or driven in any usual manner such as with a gasoline or diesel operated engine and transmission. Such means for driving the wheels are not included since they form no part of this invention.

Surface breaking equipment 14 comprises a lift apparatus which is composed of a lift cylinder 15 (illustrated in dotted lines) which has one end 16 attached to base 11. The other end 16*a* includes a piston rod 17 which is attached to a cross-member 18.

The lift system is stabilized by a plate 19 which is attached through guide rods 20 and 21 to cross-member 18. Rods 20 and 21 are stabilized by passing them through elongated bearings 22 and 23, respectively. Elongated bearings 22 and 23 are attached to base 11 in a manner so that they are rigid, thus, rods 20 and 21 can pass vertically through bearings 22 and 23, but not move from side to side.

The surface breaking equipment essentially comprises three elements a mass, a torsional spring and an oscillating member. The mass comprises a pair of vertical portions 24, one of which is illustrated in this figure, and a horizontal member 25 which connects both vertical portions. A torsional spring 26 is connected at one end with one of the vertical portions and is pivotally attached to the vertical mass illustrated as 24 in FIG. 1. Attached to torsional spring 26 is an oscillating member 27. At one end of oscillating member 27 is an oscillating force generating apparatus 28 which may be a hydraulic vibrator or the like. At the other end of oscillating member 27 is an impacting tool 29. A hydraulic power source (not shown) is coupled through hoses 30 to a hydraulic control valve 31 which is, in turn, coupled through hydraulic pipes 32 to oscillating force generator 28. An accumulator 33, for example, is supplied where necessary to dampen hydraulic pulses which may be generated in the line or to supply additional hydraulic fluid on demand as needed for the system.

A better description of the apparatus can be obtain by reference to the parent application. Such parent application is incorporated into this Application by reference.

OPERATION

The system of FIG. 1 basically operates by moving vehicle 10 by means of wheels 12 and 13 to a desired location where the surface of the earth 34, for example, is to be impacted. Upon reaching such desired location, lift cylinder 15 will lower tool 29 until it is contacting surface 34 of the earth. Such movement of the lift apparatus is accomplished by cylinder 15 being pressurized to lower piston rod 17 and as a consequence cross-member 18 which is positioned through guide rods 20 and 21 so that mass portion 24 and horizontal member 25 which are supported by cross-member 18, are also lowered. Once the assembly reaches a point where tool 29 contacts the surface of the earth 34, then additional weight is applied on tool 29. Once a predetermined load has been applied to tool 29, oscillating force generator 28 is operated causing oscillating member 27 to swing arcuately as illustrated by arrow 35. The rotational movement of oscillating member 27 will create a substantial force against the surface of the earth 34, breaking the surface, if such surface is, for example, cement and the like. Means are provided to maintain a consistent load by tool 29 against the surface of the earth 34 and likewise to protect the equipment in case tool 29 gets "hung up" or lodged against an unbroken portion of surface material 34. If such occurs and vehicle 10 is moving in the direction of arrow 37, then mass portion 24, tool and all apparatuses connected thereto will remain stationary with respect to surface 34, but will move in the direction of arrow 36 with respect to vehicle 10. Movement in the direction of arrow 36 results from the plurality of isolation mounts 40, 41 and 42 and 43 (see FIG. 2) being extremely flexible in shear. Such movement can damage the equipment if it is allowed to proceed too far. Therefore, provisions are made to limit the total movement of mass portion 24 in the direction of arrow 36 to a prescribed amount sufficient to protect the apparatus. In case such a prescribed amount is reached, then cylinder 15 will move piston rod 17 in an upwardly direction lifting tool 29 out of the broken surface of the earth 34 sufficiently to relieve the torque on mass portion 24, thus, reducing the force in the direction of arrow 36.

Figure 2:
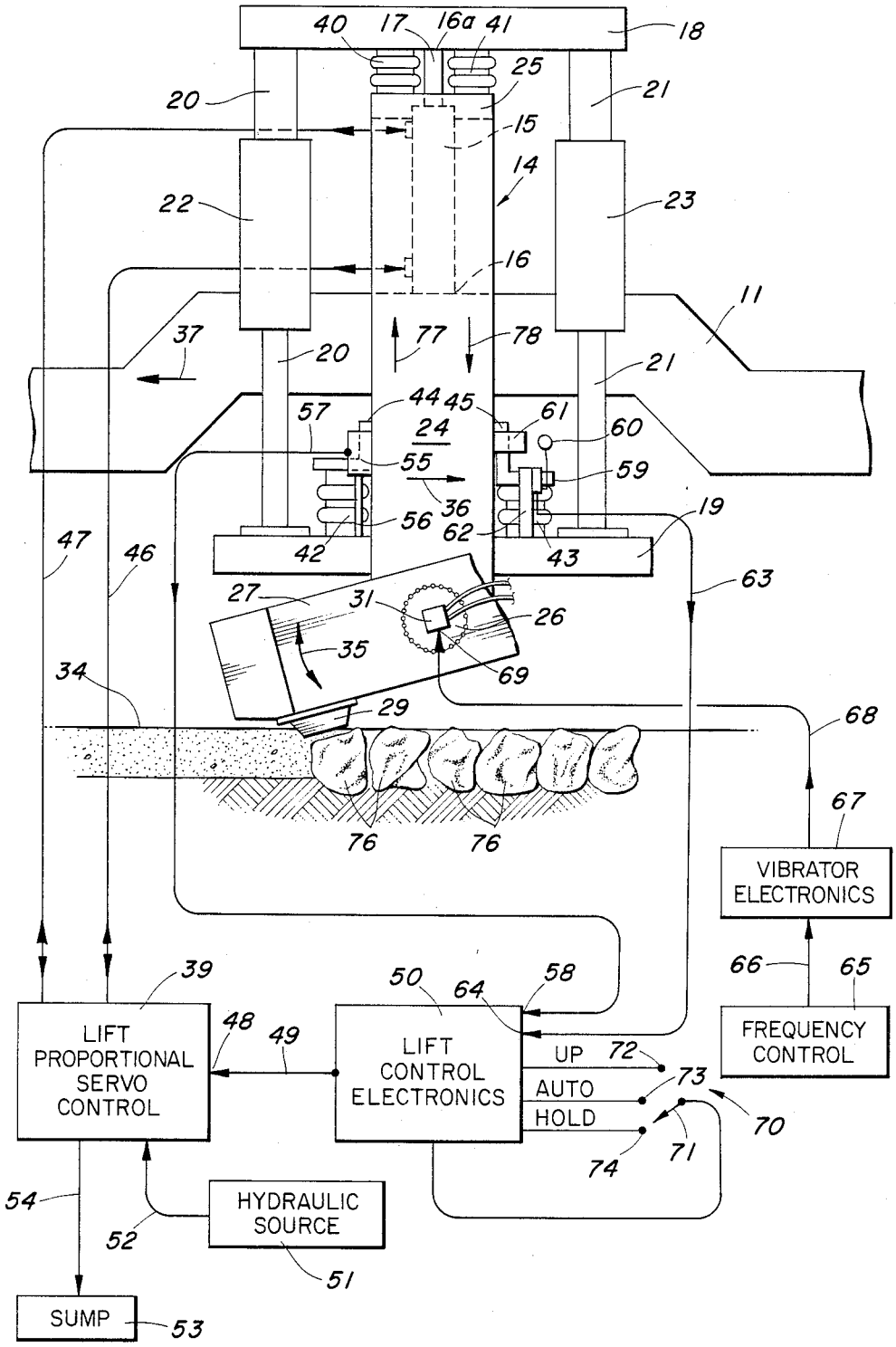
FIG. 2 is a side view of a portion of the road breaking equipment detailing the electronic circuitry in block diagram; and, FIG. 3 is a detailed drawing of the electronic circuitry and its cooperation with the road impacting equipment.

Referring to FIG. 2, surface breaking equipment is shown in more detail. In addition to the elements illustrated in FIG. 1, a pair of isolation pads 40 and 41, respectively (shown in better detail in FIG. 2), are attached between horizontal mass portion 25 and cross-member 18. Isolation members 40 and 41 provide isolation between the mass and the lift system. Other isolation members may be used as necessary, but are not illustrated. In addition, isolation members 42 and 43 are provided between vertical mass portion 24 and lower plate 19 for the purpose of attaching the mass member to lower plate 19, not only to assist in stabilization of the mass member, but also to assist in transferring force from lifting cylinder 15 to impact tool 29. "L" shaped brackets 44 and 45 are attached to vertical mass portion 24 on the one hand and to isolation means 42 and 43, respectively, on the other hand. The base of isolation members 42 and 43 are attached to lower plate 19.

The hydraulic portion of the system is not illustrated in FIG. 2 and is well known in the art, therefore, will not be described with respect to FIG. 2. The electrical control system, however, is unique to this system and therefore, is illustrated in FIG. 2 in block diagram form and in more detail in FIG. 3.

Figure 3:
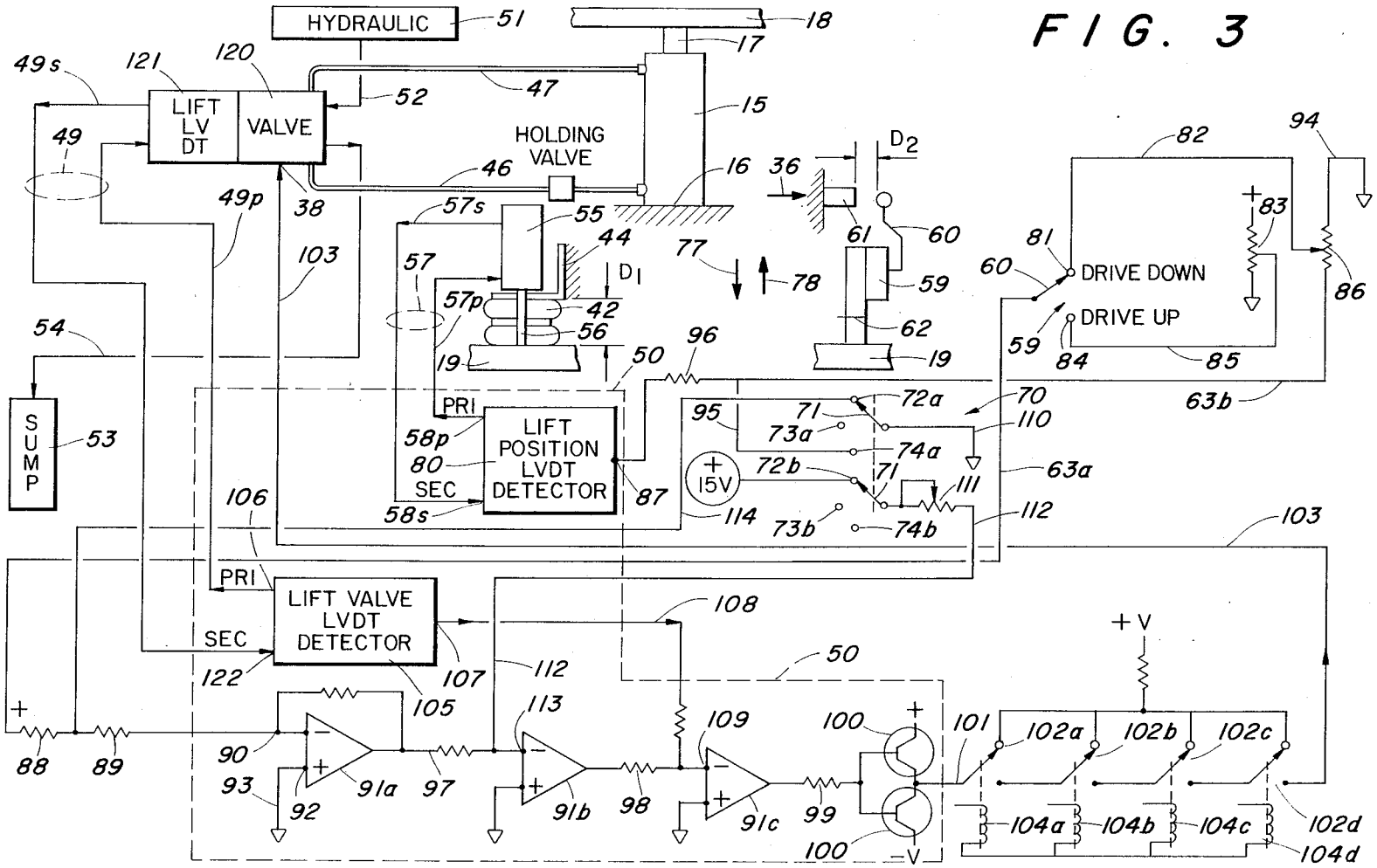

Referring in particular to FIGS. 2 and 3, a lift proportional servo-control system 39 has a hydraulic output coupled through pipe 46 to one side of lift system cylinder 15, and a second output coupled to a pipe 47 to the other end of lift system cylinder 15. Lift proportional servo-control system 39 has an electrical input 48 coupled through a wire means 49 to lift control electronics 50. A hydraulic source 51 is coupled to a pipe 52 to a hydraulic inlet of lift proportional servo-control system 39. A sump 53 is likewise coupled to a pipe 54 and to a hydraulic outlet of lift proportional servo-control system 39. A force sensing LVDT 55 is attached to vertical mass portion 24 with a sensing arm 56 communicating with the upper surface of lower plate 19. An electrical output is coupled from force sensing LVDT 55 through a wire means 57 to an input 58 of lift control electronics 50.

A horizontal force limiting apparatus comprises a micro-switch 59 which has a sensing arm 60 which is responsive to movement of a strike plate 61 attached to vertical mass portion 24. Micro-switch 59 is attached through a bracket 62 to lower plate 19. Output from micro-switch 59 is coupled through a wire means 63 to an input 64 of lift control electronics 50.

Referring to FIG. 1, the vibration of oscillating member 27 is caused by an electrohydraulic vibrator 28 which is controlled by an electrohydraulic servo-control valve 31. Such a valve is controlled by a frequency control generator 65 (see FIG. 2) which is coupled through a wire means 66 to vibrator electronics 67. Vibrator electronics 67 is coupled through a wire means 68 to an input 69 of control valve 31. Selective control is provided by a switch generally referred to by arrow 70 which provides several selections. The switch arm 71 can be in one of three selected positions: "up" position 72, "auto" position 73 and "hold" position 74.

OPERATION

The apparatus in FIG. 2 operates as follows: vehicle 10, during the breaking mode, will normally move in the direction of arrow 37. As it moves, oscillating member 27 is moving in the direction of arrow 35 breaking surface 34 to form a rubblized material as illustrated by pieces 76. The vibratory force being generated by impacting tool 29 is applied to surface 34 by lift cylinder 15 which is pressurized by lift proportional servo-control system 39 applying the weight of the apparatus and hydraulic pressure through pipe 47 to the upper portion of lift cylinder 15 with the lower portion of cylinder 15 connected through pipe 46 through lift proportional control system 39 to pipe 54 and sump 53. The amount of hydraulic pressure being supplied to pipe 47 is controlled by force sensing LVDT 55 which determines the amount of compression being applied through "L" bracket 44 through isolation means 42 to lower plate 19 and "L" bracket 45 through isolation means 43 to plate 19.

As the hydraulic pressure is being applied through pipe 47 to lift cylinder 15, both isolation members 42 and 43 and any additional isolation members, not shown, will be compressed by the weight of the supported members including members 24 through 29. The amount of compression is measured by the movement of sensing arm 56 which is coupled to the armature of LVDT 55. The amount of compression being measured through sensing arm 56 and being sensed by LVDT 55 is communicated as a signal through wire means 57 to input 58 of lift control electronics 50. This signal is processed by lift control electronics 50 which generates an output signal through wire means 49 to lift proportional servo-control system 39 which controls the pressure being applied through pipe 47 to lift cylinder 15. The predetermined load against tool 29 is determined by the position of rod 56 with respect to LVDT 55. When the armature reaches the center of LVDT 55 then, lift control electronics 50 senses the null or zero voltage from LVDT 55 indicating that the predetermined tool load is reached. The increase in hydraulic pressure through pipe 47 to lift control cylinder 15 is then stopped and the set pressure maintained during the breaking operation.

On occasions, tool 29 may suddenly break through surface 34 and become lodged or "hung up" on surface 34. When this occurs with vehicle 10 moving in the direction of arrow 37, horizontal force will be applied to oscillating member 27 causing movement of mass portion 24 in the direction of arrow 36. The above is caused because vertical mass member 24 and horizontal mass member 25 are all attached to yieldable isolation means 40, 41, 42 and 43, for example, along with other isolation means similar but not illustrated in the drawings (such additional isolation means are shown in the parent application) If the force being applied in the direction of arrow 36 causes strike plate 61 to strike sensing arm 60 of micro-switch 59, then a signal will be communicated through wire means 63 to input 64 of lift control electronics 50. Such a signal will cause lift control electronics 50 to generate a signal through wire means 49 to lift proportional servo-control 39 to cause a reversal of hydraulic fluid in pipes 46 and 47, thereby pressurizing pipe 46 and transferring the pressure from pipe 47 to sump 53. The above response will cause an immediate movement of lift system 14 in the direction of arrow 77.

Once tool 29 is free of its obstruction, that is, once the horizontal force causing a force in the direction of arrow 36 is relieved, then arm or bracket 61 will move away from sensing arm 60 causing the switch to open, removing the signal on wire means 63. Once the signal on wire means 63 is removed, hydraulic fluid causing pressure in hydraulic pipe 46 will be transferred to sump 54 and pressure on pipe 47 will be returned until the predetermined load is again being applied to tool 29 as previously discussed.

Switch 70 has several modes of operation. During travel, switch 70 will have its arm 71 transferred to contact 72 in the "up" mode which will cause lift proportional servo-control system to pressurize pipe 46 and depressurize pipe 47 lift system 14 to its upmost position. In such a position the apparatus can be locked in place by a series of locking devices (not shown) which will releasably lock surface breaking equipment 14 in the "up" position so that when the hydraulic pressure is shut off tool 29 will remain in the "up" position.

When switch arm 71 is transferred to contact 73, tool 29 will operate as previously described. When switch arm 71 is transferred to contact 74 or the "hold" position, tool 29 is generally raised a slight amount above surface 34 and held in that position so that the apparatus can cross a ditch or can be moved to another location on the same surface without having to physically raise the tool the entire height up to and into the locked position as discussed.

Referring to FIG. 3, a more detailed circuitry is illustrated for the electronics used to control the lift system of the surface breaking apparatus. In addition to the elements already described in FIGS. 1 and 2, lift control electronics 50, illustrated in FIG. 3 by a dashed-lined box, comprises a lift positional LVDT detector 80 which has its input and output coupled to lift position LVDT 55 through wire means 57 as previously discussed. LVDT 55, however, contains a primary and secondary winding. The primary is coupled through wire means **57*p* and the secondary is coupled through wire means 57*s*. Wire means 57*s* is inputted into LVDT detector through input 58*s* while the primary is coupled to LVDT detector through 58*p***.

The apparatus specifically described in FIG. 3 and generally described in FIG. 2 controls several important functions of the breaking apparatus. First, it provides a means of raising and lowering the tool away from, or in contact with the surface of the earth 34. Secondly, it provides a means for applying a specific load against the tool during the breaking process and third, it selectively raises or lowers the tool in case the tool becomes lodged during the period of time carrier vehicle 10 is moving. The third feature provides protection against damaging the suspension system which isolates the breaking equipment from the vehicle itself. As generally discussed, in order to prevent the suspension system from being unduly stressed when tool 29 (see FIG. 2) is lodged against a piece of material being broken, strike plate 61 impacts switch arm 60 triggering switch 59.

In FIG. 3, switch 59 is shown in detail as having a switch arm 60, a contact 81 and a second contact 84. Contact 81 is coupled through a wire means 82 to a potentiometer 86 providing an adjustable voltage to contact 81 which normally will move the tool in a downwardly direction Switch contact 84 is coupled through a wire means 85 to a voltage divider 83. The voltage at contact 84 will drive the lift system in an upwardly direction in a manner to remove tool 29 from the object which is lodging or hanging up tool 29. The output from switch 59, which is selected by switch arm 60, is coupled through a wire means **63*a* to a pair of resistor 88 and 89 to an input 90 of operational amplifier 91*a*. The positive side of operational amplifier 91*a* is coupled at 92 through a wire means 93 to ground. One end of adjustable voltage divider 86 is coupled through a wire means 94 to ground and the other end of adjustable voltage divider 86 is coupled through wire means 63*b* and wire means 95 to contact 74*a* of switch 70 and through a resistor 96 to input 87 of lift position LVDT detector 80. Switch contact 72*b*** is coupled to a $\pm 15$ volt source of power.

Operational amplifier **91*a* is coupled through a wire means and resistor combination 97 to resistor input 113 of a second operational amplifier 91*b*. The output from operational amplifier 91*b* is likewise coupled through a wire means and resistor combination to the input 109 of a third operational amplifier 91*c*. Operational amplifier 91*c* is coupled through a third wire means and resistor combination 99 to a pair of output transistors 100. Output transistors 100 are coupled through their output 101 to a series of switches 102*a*, 102*b*, 102*c* and 102*d*. These switches are on the lift apparatus and are used to detect the condition of the lift apparatus which will be either in the locked "up" or "down" position. During normal transport, it is not feasible to maintain hydraulic pressure on the lift system at all times, therefore, the lift system, once it is in the full "up" position, is mechanically locked in placed by a series of locks which have not been illustrated. They are well known in the art. Such locks will activate switches 102***a* through 102*d*. These switches, in the position illustrated, prevent any signal from passing from output 101 to a wire means 103 which couples a signal from operational amplifiers 91*a* through 91*c* and transistors 100 to input 38 of control valve 120. Such signal will normally control the position of hydraulic cylinder 15 in either the "up" or the "down" position When the mechanical stops are removed by miniature air-actuated cylinders 104*a* through 104*d*, then switches 102*a* through 102*d* are simultaneously closed. All of cylinders 104*a* through 104*d* must have removed the stops before all switches 102*a* through 102*d* are closed and the circuit will be complete between wire means 101 and wire means 103.

The actual control of lift valve 120, as to its function of lifting the surface breaking equipment or lowering the surface break equipment or the third function of applying a predetermined load to the surface breaking equipment, is accomplished by a signal from lift portion LVDT detector 80 which signal is applied to input 38 by passing through switch 59, through wire means 63*a* to operational amplifiers 91*a*, 91*b* and 91*c* then transferring to wire means 103 and to input 38 of valve 120. The actual spool position of valve 120 is detected by lift valve LVDT detector 105 through a primary output 106 which is applied through wire means 49*p* to LVDT 121 in valve 120. The secondary, which generates a signal responsive to the actual position of the valve, is outputted through wire means 49*s* to secondary input 122. An output voltage is applied at output 107 of lift valve detector 105 through wire means 108 and resistor combination to input 109 of operational amplifier 91*c*. In order to selectively control valve 120, switch 70 has three positions, as previously discussed, an "up" on terminals 72*a* and 72*b*, an "auto" position on 73*a* and 73*b* and a "hold" position on 74*a* and 74*b*. Selector switch 71 for contacts 72*a* through 74*a* is coupled through 110 to ground, while the selector portion of switch 74 contacts 72*b* through 74*b* is coupled through a potentiometer 111 to a wire means 112 to an input 113 of operational amplifier 91*b*. Terminal 72*a* is coupled through a wire means 114 to the junction between resistors 88 and 89.

The holding valve in hydraulic line 46 is a form of check valve which, to allow reverse flow, requires a hydraulic pressure higher than that necessary to support the weight of surface breaking equipment 14 in order to control the rate that surface breaking equipment 14 is lowered. Without the holding valve, pressurizing pipe 47 and connecting pipe 46 to sump 53 would cause equipment 14 to drop immediately to the surface of the earth 34.

OPERATION

"Up" Position

The circuit shown in FIG. 3 operates in the following manner: referring to selector switch 70 with the selector contacting pins 72*a* and 72*b*, the ground is then applied through wire means 110, contact 72*a* and wire means 114 to the junction between resistors 88 and 89. The signal at op amps 91*a* through 91*c* are reverse connected, that is, a positive signal at each of the inputs will generate a negative signal at each of the outputs, and vise versa. Junction 88,89 will apply a virtual ground to input 90 of op amp 91*a* driving op amp 91*a* to zero (0) volts at the output at wire means and resistor location 97 of op amp 91*a*. The zero (0) volts, basically, then will drive op amp 91*b* positive which is transferred to input 109 of op amp 91*c* driving it negative. The negative voltage applied then at the output of 91*c* is amplified in transistors 100 and passes through wire means 101, switches 102*a* through 102*d* to wire means 103 which then applies the negative voltage to input 38 of valve 120. Valve 120 is basically a well known valve using a torque motor to control a spool valve. Such negative voltage will drive the torque motor and consequently the spool valve in a direction to force hydraulic fluid into pipes 46 and out of pipes 47 causing shaft 17 to extend lifting cross-member 18 upwardly thereby causing the surface breaking equipment to lift tool 29 from the ground. In order to control the total movement of the spool valve contained in valve 120, a feedback system is developed which is generated by the lift LVDT. When the spool valve shifts in a direction to cause hydraulic fluid to flow into pipe 46 and out of pipe 47, it simultaneously shifts the mechanical position of lift valve LVDT causing an output on wire means 49*s* to the secondary input 122 of lift valve LVDT detector 105. This sequence of events will then cause an output at 107 which will generate a signal in wire means 108 to input 109 of op amp 91*c* causing a countervoltage to develop. Such countervoltage will return valve 120 eventually to its center position.

AUTO POSITION

When selector switch 70 is placed in the "auto" position, switch selector 71 is in contact with switch contacts 73*a* and 73*b*. Neither 73*a* nor 73*b* is connected to any circuitry and since these switch contacts are no longer connected to ground, then the junction between 88 and 89 is allowed to assume the potential which will be generated by lift proportional LVDT detector 80 at its output 87. Such signal is applied through resistor 96 and wire means 63*b* through potentiometer 86 to ground. The adjustable arm of potentiometer 86 is then applied through wire means 82 to switch contact 81 through selector arm 60 of switch 59 to wire means 63*a* where it is subsequently applied to resistor 88. Since the junction between 88 and 89 is no longer grounded, then input 90 of op amp 91*a* can seek the voltage being generated by the output of lift proportion LVDT detector 80.

On the "automatic" position, if tool 29 is not in contact with the ground, then the distance D1 of isolation mounts 42 will be its maximum dimension and rod 56 will measure this maximum dimension and transfer the information to the secondary winding of LVDT 55 through 57*s* to the input 58 to LVDT detector 80. The unbalanced voltage being detected by the secondary in LVDT detector 55 will then generate a voltage at the output 87 of position detector 80 and apply this voltage to wire means 63*b* and subsequently to the junction of resistor 88. This voltage will be polarized to pass through op amps 91*a*, 91*b* and 91*c* to wire means 103 which, when applied to valve 120, will cause valve 120 to apply hydraulic pressure in lines 47 and remove the hydraulic fluid from line 46, thus, driving cylinder 15 downwardly and cross-member 18 downwardly until tool 29 strikes the surface of the earth 34 (see FIG. 2). Downward pressure will continue to drive cross-member 18 downward until rod 56 measures distance D1 and determines that D1 is proper for applying a sufficient weight against tool 29. The lift LVDT will, after a period of delay, generate an error signal through its secondary on wire means 49*s* to input 122 of lift valve LVDT detector 105. A countering output signal will be applied from output 107 through wire means 108 to input 109 of op amp 91*c*. Once the signal from LVDT 55 is reduced due to D1 reaching the proper dimension, then the countering signal from lift LVDT in valve 120 will return the voltage at 109 to neutral causing the spool valve in 120 to return to its center position. Such center position will cause the lift LVDT to drop to zero (0) voltage and subsequently reduce the voltage applied from output 107 through wire means 108 to input 109 of op amp 91*c*. Potentiometer 111 basically can be set to determine the rate or speed that the lift system travels during an "up" or "down" command.

In case tool 29 should get lodge against a piece of rubble or gets "hung up" for some reason during the time the vehicle is tramming, then horizontal force will be applied against tool 29 and vertical member 24. When the above occurs, strike plate 61 will move closing the distance D2. If strike plate 61 should strike switch arm 60 in a manner sufficient to close switch 59 or in a manner to move switch arm 60 from contact 81 to contact 84, then a positive 15 volts will be applied at junction 83 which will pass through wire means 85, switch arm 60 of switch 59 through wire means 63*a* to resistor 88. Such positive voltage will drive the output of op amp 91*a* negative in much the same manner as the "up" command previously described for switch 70. When such command is received at valve 120, it will apply hydraulic fluid to pipe 46 and out of pipe 47 driving cross-member 18 upwardly lifting the surface breaking equipment up from and out of the entrapped position of tool 29. Once tool 29 is released, then distance D2 will widen causing switch arm 60 to return to contact 81 returning the entire system to its normal "auto" mode.

HOLD POSITION

In the "hold" position, switch 70 has its selector arms 71 connected to contacts 74*a* and 74*b*. In this position, output from lift position LVDT detector 80 is grounded which applies a ground signal to the junction between resistors 88 and 89, removing all signals to valve 120. With no signal to valve 120, the hydraulic pressure in cylinder 15 will not exceed that necessary to overcome the differential pressure required by the holding valve, thus, surface breaking equipment 14 will remain at the vertical position it was in when switch arm 71 was rotated to contacts 74*a* and 74*b*.

CONCLUSIONS

In view of the above, it is obvious that the surface breaking equipment can be controlled in an "up" locked position to a down "automatic" position where the tool can be in contact with the surface of the earth during the road breaking operation along with maintaining a predetermined force against the tool at all times, such predetermined force being adjusted by the setting of the distance D1 of LVDT 55. In addition to the above, if the tool should become lodged or "hung up" for some reason during the tramming operation, then the horizontal force will cause strike plate 61 to strike switch arm 60 causing the lift system to lift the tool out of the lodged position. Once the above occurs, the "automatic" mode will again control the lift system in a manner to return the tool to the surface of the earth and apply a predetermined vertical force against the tool so that the breaking operation can continue. It is obvious that other modifications and changes can be made and still be well within the spirit and scope of this invention as described in the specifications and appended claims.

What I claim is:

1. Apparatus for controlling the total force being applied to a tool means in contact with a surface comprising:

(a) force generation means;

(b) elastic means having a first and second surface means;

(c) means for coupling said force generation means to said first surface means;

(d) means for coupling said tool means to said second surface means;

(e) means for measuring the distance between said first surface means and said second surface means;

(f) means coupled to said means for measuring the distance for generating an output corresponding to the said measured distance; and, (g) means responsive to said output, coupled to said force generation means in a manner to regulate the total force generated when said distance measures a preselected amount;

whereby when said elastic means is crushed by a predetermined distance a desired total force is realized.

2. Apparatus as claimed in claim 1 wherein said means for measuring the distance between said first surface means and said second surface means is a LVDT having an input and an output coupled to said responsive means.

3. Apparatus as claimed in claim 1 wherein elastic means has a vertical oriented axis when said elastic means has substantially no forces on said second surface means with respect to said first surface means, said means for measuring the distance of said vertical oriented axis from said vertical orientation which will be displaced when horizontal forces are applied to said second surface means, means for generating an output signal when said vertical oriented axis reaches a predetermined displacement; control means accepting said output signal and generating a control signal which is coupled to said force generation means in a manner to reduce said force being generated by an amount less than said total force until said displacement of said vertical oriented axis is reduced below said predetermined displacement; whereby said control signal is reduced by an amount sufficient to return said force generation means to its predetermined total force against said tool.

4. Control apparatus for an impact arm having an impact tool on one end and a vibration apparatus on the other end, of a mobile pavement breaking apparatus which includes a carriage, lifting means for raising and lowering said impact arm and impact tool out of and into contact with a surface to be broken and for applying an additional vertical force to said tool, said control apparatus comprising:

(a) means for measuring the total vertical force being applied through said lifting means to said impact tool, and generating an output signal responsive to said vertical force;

(b) means for limiting the amount of horizontal force being applied to said impact tool, said means for limiting generating an output signal when said force horizontal reaches a predetermined amount;

(c) first processor means receiving said output signal from said measuring means and generating an output signal;

(d) lift control means having an input which receives said first process means output signal and generates an output which is coupled to said lifting means in a manner to control the vertical force being applied to said impact tool, and;

(e) second processor means having an input which receives the output signal from said means for limiting and generates an output which is coupled to an input of said lift control means in a manner to counter said vertical force being applied to said impact tool when said horizontal force reaches a predetermined amount;

whereby said lifting means maintains a predetermined vertical force on said tool against said surface to be broken, and reduces said vertical force if said tool becomes jammed on said impacted surface in a manner to exceed a predetermined horizontal force.

5. Apparatus as claimed in claim 4 wherein said means for measuring said vertical force comprises:

a plurality of isolation means, each including an elastic means with first and second parallelly spaced surfaces; LVDT means having a housing and an armature, said housing attached to said first surface of one of said elastic means and said armature in contact with said second surface;

wherein the variations in the dimensions of said elastic means can be measured by said LVDT and outputted to said first processor means.

6. Apparatus as claimed in claim 4 wherein said means for limiting the amount of horizontal force comprises:

a switch means mounted between said carriage and said lifting means, said switch means having at least a switch arm and a switch impact arm, said switch arm spaced from said switch impact arm by an amount providing a fixed displacement of said switch impact arm toward said switch arm upon the application of said horizontal force;

whereby if said horizontal force exceeds a predetermined amount, said displacement will cause said impact arm to strike said switch arm whereby said switch will cause an output signal to reduce said force on said impact tool.

7. Apparatus as described in claim 5 wherein said means for limiting the amount of horizontal force comprises:

a switch means mounted between said carriage and said lifting means, said switch means having at least a switch arm and a switch impact arm, said switch having a switch arm spaced from said switch impact arm by an amount providing a fixed displacement of said switch impact arm toward said switch arm upon the application of shear force;

whereby if said horizontal force exceeds a predetermined amount, said displacement will cause said impact arm to strike said switch arm whereby said switch will cause an output signal to reduce said force vertical on said impact tool.

8. Surface breaking apparatus for controlling the total force being applied to an impact tool means in contact with a surface of the earth comprising:

(a) force generation means;

(b) elastic means having a first and second surface means;

(c) means for coupling said force generation means to said first surface means;

(d) means for coupling said tool means to said second surface means;

(e) means for measuring the distance between said first surface means and said second surface means;

(f) means coupled to said means for measuring said distance and for generating an output corresponding to the said measured distance; and (g) means responsive to said output coupled to said force generation means in a manner to regulate the total force generated when said distance measures a preselected amount, whereby when said elastic means is deflected by a predetermined distance a desired total force is realized.

9. Apparatus as claimed in claim 8 wherein said means for measuring the distance between said first surface means and said second surface means is a LVDT having an input and an output coupled to said responsive means.

10. Apparatus as claimed in claim 8 wherein the distance measured by said means for measuring the variation in distance between said first and second surface means caused by a horizontal force on said impact tool means, and wherein said output signal is generated when said horizontal force reaches a predetermined value; control means accepting said output and generating a control signal which is coupled to said force generation means in a manner to reduce said vertical force being generated until said measured distance is reduced below said predetermined value; whereupon said signal to said force generation means is reduced by an amount sufficient to return said force generation means to its predetermined total force against said tool.

* * * * *